United States Patent [19]

Sakamoto et al.

[11] Patent Number: 4,799,266

[45] Date of Patent: Jan. 17, 1989

[54] ELECTROACOUSTIC CONVERTER

[75] Inventors: Yoshio Sakamoto, Hachiohji; Kaoru Yamazaki, Akikawa, both of Japan

[73] Assignee: Kabushiki Kaisha Kenwood, Tokyo, Japan

[21] Appl. No.: 125,205

[22] Filed: Nov. 25, 1987

[30] Foreign Application Priority Data

Nov. 25, 1986 [JP] Japan ..... 61-179694[U]
Nov. 26, 1986 [JP] Japan ..... 61-180562[U]

[51] Int. Cl.[4] ..... H04R 7/18; H04R 7/20

[52] U.S. Cl. ..... 381/193; 381/194; 381/199; 381/202

[58] Field of Search ..... 381/202, 201, 204, 192, 381/193, 194, 197, 199; 181/171, 172; 335/231

[56] References Cited

U.S. PATENT DOCUMENTS

| | | | |
|---|---|---|---|
| 2,501,032 | 3/1950 | Harbaugh | 381/194 X |
| 2,554,859 | 5/1951 | Hoekstra et al. | 381/194 |
| 2,590,935 | 4/1952 | Charlesworth | 381/199 X |
| 2,604,551 | 7/1952 | Charlesworth | 381/197 |
| 2,670,807 | 3/1954 | Brown | 381/194 X |
| 2,910,546 | 10/1959 | Swanson | 381/193 |
| 3,106,670 | 10/1963 | Laux | 335/231 X |

FOREIGN PATENT DOCUMENTS

| | | | |
|---|---|---|---|
| 0037738 | 10/1978 | Japan | 381/204 |

*Primary Examiner*—Eugene R. LaRoche
*Assistant Examiner*—Seung Ham
*Attorney, Agent, or Firm*—Gerald J. Ferguson, Jr.

[57] ABSTRACT

An electroacoustic converter comprising a magnetic circuit including a center pole, a magnet and a top plate with an upper side surface of the center pole being space from an adjacent side of the top plate. The top plate includes an incision on a horizontal rear surface thereof and a horizontal part adjacent to the incision. A diaphragm system is provided over the top of the center pole and includes a dome-like diaphragm, a cylinderical bobbin on which a voice coil is wound, and a brim-like suspension which extends outwardly from the bobbin. A guide ring is bridged between a ledge on a vertical surface of the center pole and the incision of the top plate. The periphery of the suspension of the diaphragm system is fixedly sandwiched between the horizontal part of the guide ring and the horizontal surface of the top plate.

3 Claims, 3 Drawing Sheets

ELECTROACOUSTIC CONVERTER

BACKGROUND OF THE INVENTION

1. Field of the Invention

The present invention relates to an electroacoustic converter, and more particularly is directed to an improvement on an electroacoustic converter such as a loudspeaker or a microphone having a dome-like diaphragm.

2. Related Background Art

In a conventional dome-like loudspeaker, the magnetic circuit is constructed of a center pole, a yoke, a magnet and a top plate. A magnetic gap is formed between the outer wall of the center pole and the inner wall of the top plate. A known diapharagm system is constructed of a unit body of a dome-like diaphragm and a coil bobbin section integrally formed with the diaphragm and having a voice coil wound thereabout, and a curved edge section attached to the unit body. Another is constructed of a unit body of a dome-like diaphragm and an edge section, and a coil bobbin attached to the unit body. In such diaphragm system, the coil bobbin section together with the voice coil is properly inserted in the magnetic gap. Conventionally, a jig shown has been used to precisely define a magnetic gap during an assembly process of a loudspeaker. The jig is formed with a tubular section whose thickness corresponds to the magnetic gap, and the top plate is assembled by covering the tubular section on the center pole. The magnetic circuit elements are coupled together with adhesive agent, and after drying and hardening of the adhesive agent, the jig is removed to complete the magnetic circuit.

Conventional magnetic circuits described above have required a jig for formation of an adequate magnetic gap. In addition, to remove the jig after hardening of the adhesive agent, it is necessary to provide some clearances g between the center pole and the tubular section and between the tubular section and the top plate. As a result, there are associated with some problems that it is difficult to obtain a uniform gap, and that the clearance g must necessarily be incorporated to define the gap distance. This clearance g degrades particularly the performance of a high frequency loudspeaker. Further, use of an adhesive agent for bonding each magnetic circuit element requires a time for drying and hardening, therby resulting in a loss in time during an assembly process.

A dome-like loudspeaker is constructed in such a way that the outer periphery or brim of the edge section extended from the diaphragm is sandwiched between the ring-like edge supporting members which are bonded to the top plate for support of the diaphragm system. With such construction, the leads of the coil wound about the coil bobbin section are drawn to the side of the edge section and sandwiched between the edge supporting members. Generally, a middle- and high-frequency dome-like loudspeaker of this type is small in dimension and has a narrow edge section. Therefore, the leads are carefully guided so as not to contact the edge section or the top plate, and carefully sandwiched so as not to cut or make short-circuited. Such wiring operation of the leads is very difficult and complicated at a limited working space, thus causing a low productivity and a low yield.

In co-pending U.S. application Ser. No. 871,836 filed June 9, 1986, an improvement was proposed. In one example of the improvement, the center pole is chipped off at its shoulder and is mechanically engaged directly with the top plate to define a magnetic air gap. In order to increase the magnetic reluctance at the engaged portions of the center pole and the top plate for the purpose of keeping a high magnetic field in the air gap, the center pole and the top plate are abutted at their corners. In another example, a cylindrical insulator pipe is provided on the outer surface of the center pole. The lower shoulder of the top plate is engaged with the center pole through the pipe to define the magnetic air gap.

SUMMARY OF THE INVENTION

The object of the present invention is to provide a further improvement on electroacoustic converters such as a loudspeaker or microphone having a dome-like diaphragm.

According to the invention, there is provided an acoustic converter comprising:

(a) a magnetic circuit including a center pole, a magnet and a top plate, an air formed between an upper side surface of the center pole, and an adjacent end of the top plate, the center pole including a ledge on a vertical surface thereof and the top plate including an incision on a horizontal rear surface thereof and a horizontal part adjacent to the incision;

(b) a diaphragm system including a dome-like diaphragm, a cylindrical bobbin on which a voice coil is wound and a brim-like suspension which extends from the bobbin; and (c) a guide ring bridged between the edge of the center pole and the incision of the top plate, the guide ring including a horizontal part on the periphery thereof;

wherein the periphery of the suspension of the diaphragm system is fixedly sandwiched between the horizontal part of the guide ring and the horizontal surface top plate.

DETAILED DESCRIPTION OF THE EMBODIMENTS

Figure 1A:
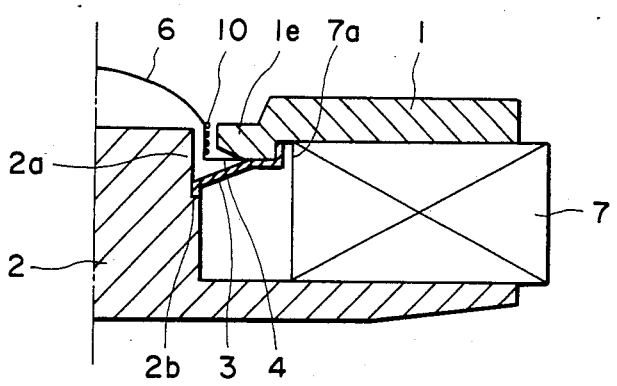
FIG. 1A is a cross-section view of a first embodiment of the acoustic converter according to the present invention.
Figure 1B:
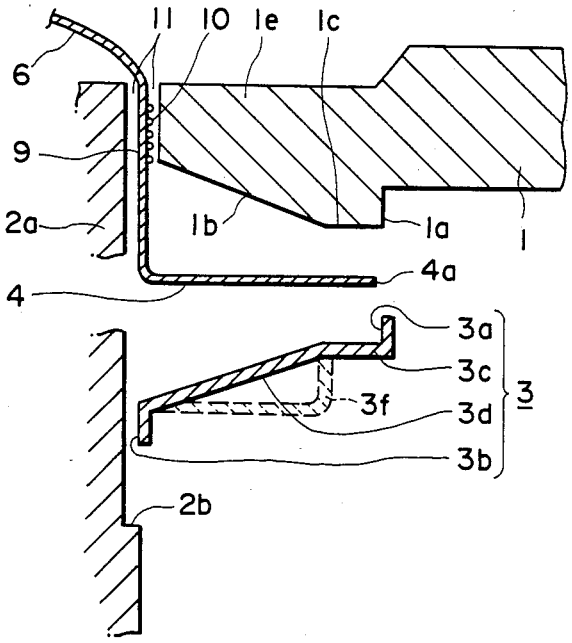
FIG. 1B is a fragmentary view of the first embodiment of FIG. 1A.
Figure 1C:
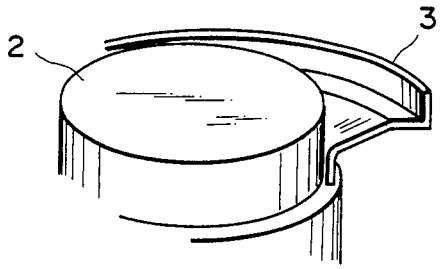
FIG. 1C is a perspective view of a guide ring of the first embodiment of FIG. 1A.

FIG. 1A shows a cross-section of the first embodiment of a dome-like loudspeaker according to this invention. FIG. 1B is an exploded view of the essential portion of the loudspeaker. The loudspeaker is composed of a dome-like diaphragm 6, a center pole piece 2, a magnet 7, a top plate 1 and a guide ring 3. The diaphragm 6 has a cylindrical coil bobbin 9 with a coil 10 wound around the bobbin. A brim-like suspension 4 extends horizontally from the bottom of the bobbin 9. A step comprising a vertical wall 2a and a horizontal ledge 2b is formed on top of the center pole 2. The guide ring 3 has an appearance shown in FIG. 1C and is mounted on the horizontal ledge 2b of the center pole 2 step. The guide ring is formed from an insulating plate, or non-magnetic metal plate, having a predetermined thickness. It includes a vertical cylindrical portion 3b just fitted over the cylindrical vertical wall 2a of the center pole 2, an oblique portion 3d (or L-like portion 3f), a horizontal portion 3c and a vertical portion 3a. The suspension 4 of the diaphgragm 6 is placed on the horizontal potion 3c of the guide ring 3 and the outer periphery 4a of the suspension 4 abuts against the perphery wall of the vertical portion 3a. A step is provided on the inner lower surface of the top plate 1 which is placed on the magnet 7 so that the vertical wall 1a of the step abuts against the inner periphery wall of the vertical portion 3a of the ring guide 3. The top plate 1 has a horizontal surface portion 1c formed adjacent to its step. When the top plate 1 is placed on the magnet 7, the outer periphery of the suspension 4 of the diaphragm 6 is sandwiched between the horizontal portion 1c and the horizontal portion 3c of the ring guide 3 to fix the outer periphery of the suspension 4. Provided inside the horizontal surface portion 1c is an oblique portion 3d of the ring guide 3 to form a space therebetween in which the suspension 4 is placed vibratably. The vertical inner periphery wall of the top plate 1 and the outer periphery wall 2a of the center pole cooperates to form an air gap 11 therebetween in which the coil 10 is disposed.

In this way, the top plate 1 and diaphragm 6 are disposed accurately by using the guide ring 3 without using a jig.

Figure 2:
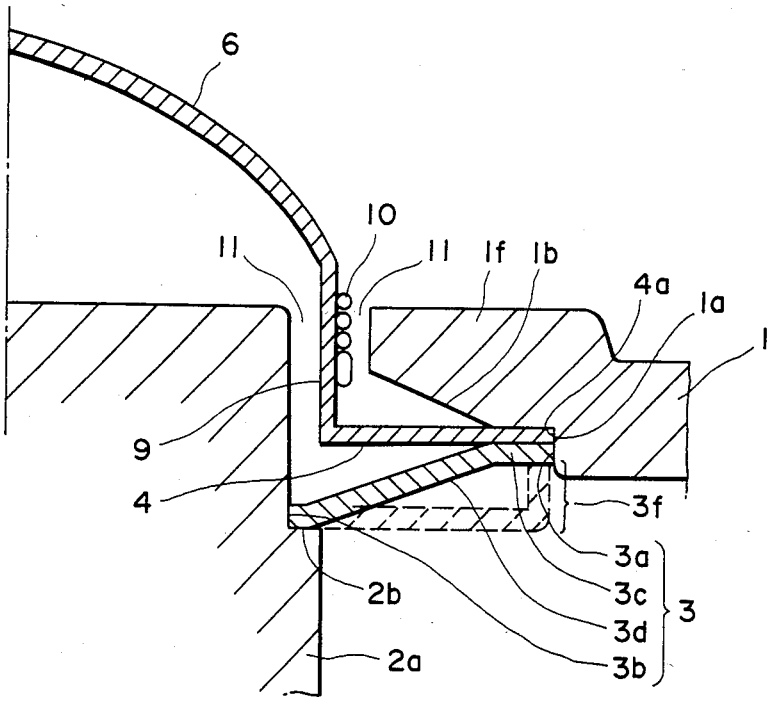
FIG. 2 is a cross-section view of a second embodiment of the acoustic converter according to the present invention.

FIG. 2 shows a second embodiment in which the ring guide 3 is disposed so that the outer periphery 3a of the horizontal portion 3c abuts against the inner vertical periphery of a step in the top plate 1 instead of a vertical portion such as 3a in the first embodiment.

Figure 3:
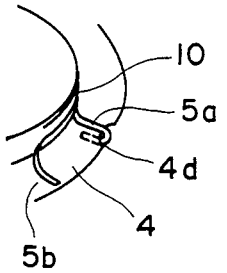
FIG. 3 and FIG. 4 respectively show a first and a second example of a manner to handle lead ends.
Figure 4:
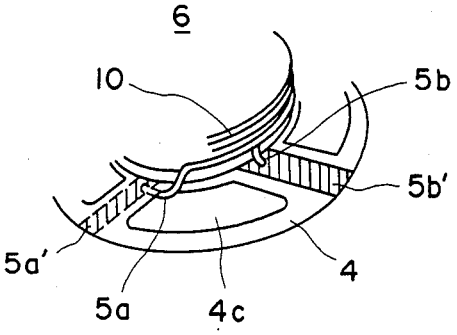
Figure 5:
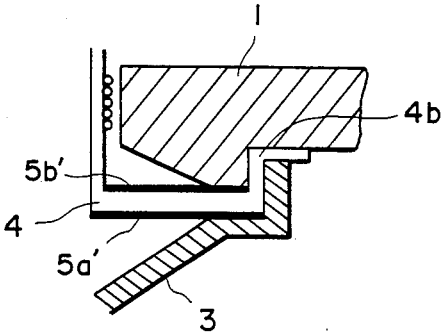
FIG. 5 is a fragmentary cross-section view of a third embodiment of the acoustic converter according to the present invention.

In the embodiment of this invention, the leads 5a and 5b of the coil 10 are as shown in FIG. 3 or FIG. 4. In FIG. 3, one lead 5a is led via a notch 4d in the suspension 4 to under the suspension 4 and the other lead 5b is led over the suspension. In FIG. 4, printed conductors 5a' and 5b' are respectively provided on the upper and lower surfaces of the suspension 4 and electrically connected to the corresponding leads 5a and 5b. In such lead structure, when the suspension 4 is held between the conductive top plate 1 and the non-magnetic electrically conductive guide ring 3, the lead 4a is electrically connected to the conductive center pole via the guide ring 3 and the lead 4b is connected to the top plate 1. In this case, the surface portions of the guide ring 3 and top plate 1 which abut must be electrically isolated from each other. The insulating member for this may be, for example, a suspension structure including an inverted L-like member 4b, as shown in FIG. 5.

Therefore, if connection terminals are provided on the center pole, a york and the top plate, leads and silk thread wires can be disposed in the magnetic circuit in a simple manner and not in a complicated manner.

It is to be noted that the magnet 7 is made of a non-conductive material, for example, a ceramic material, so that insulation between the two leads is maintained.

What is claimed:

1. An acoustic converter comprising:

(a) a magnetic circuit including a center pole, a magnet and a top plate, an air gap being formed between an upper side surface of the center pole and an adjacent end of the top plate, the center pole including a ledge on a vertical surface thereof, and the top plate including an incision on a horizontal rear surface therof and a horizontal part adjacent to the incision;

(b) a diaphragm system including a dome-like diaphragm, a cylindrical bobbin on which a voice coil is wound and a brim-like suspension which extends from the bobbin; and (c) a guide ring bridged between the ledge of the center pole and the incision of the top plate, the guide ring including a horizontal part on the periphery thereof;

wherein the periphery of the suspension of the diaphragm system is fixedly sandwiched between the horizontal part of the guide ring and the horizontal surface of the top plate.

2. An acoustic converter according to claim 1, wherein the adjacent end of the top plate includes a rear oblique surface and the guide ring includes and oblique part opposite to the oblique surface of the top plate so that a space is formed between the oblique part of the guide ring and the oblique surface of the top plate.

3. An acoustic converter according to claim 1, wherein said guide ring is made out of a non-magnetic conductive material and one end of the voice coil electrically contacts the guide ring.

* * * * *